US012644640B2

(12) United States Patent
Hu et al.

(10) Patent No.: US 12,644,640 B2
(45) Date of Patent: Jun. 2, 2026

(54) REFRIGERATOR APPLIANCE WITH CONDENSATION MITIGATION FEATURES

(71) Applicant: Haier US Appliance Solutions, Inc., Wilmington, DE (US)

(72) Inventors: Haitian Hu, Louisville, KY (US); Steven Keith Root, Buckner, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 86 days.

(21) Appl. No.: 18/584,547

(22) Filed: Feb. 22, 2024

(65) Prior Publication Data

US 2025/0271203 A1 Aug. 28, 2025

(51) Int. Cl.

| | |
|---|---|
| ***F25D 29/00*** | (2006.01) |
| ***F25D 21/00*** | (2006.01) |
| ***F25D 21/04*** | (2006.01) |

(52) U.S. Cl.

CPC ..... *F25D 29/00* (2013.01); *F25D 21/006* (2013.01); *F25D 21/04* (2013.01); *F25D 2700/02* (2013.01)

(58) Field of Classification Search

CPC ..... F25D 29/00; F25D 21/006; F25D 21/04; F25D 2700/02

See application file for complete search history.

(56) References Cited

U.S. PATENT DOCUMENTS

| | | | | |
|---|---|---|---|---|
| 5,638,694 | A * | 6/1997 | Banicevic | F25D 21/04 62/277 |
| 9,291,383 | B2 * | 3/2016 | Besore | F25D 21/02 |
| 11,768,031 | B1 | 9/2023 | Schroeder et al. | |
| 2010/0275631 | A1 * | 11/2010 | Wiest | F25D 21/04 219/494 |
| 2017/0219269 | A1 * | 8/2017 | Ahn | F25D 21/02 |
| 2017/0225336 | A1 * | 8/2017 | Deyle | B25J 11/008 |
| 2018/0372332 | A1 | 12/2018 | Cha et al. | |
| 2019/0004491 | A1 | 1/2019 | Wilson | |
| 2021/0164663 | A1 | 6/2021 | Yoon | |
| 2022/0049895 | A1 * | 2/2022 | Oh | G05D 23/1902 |
| 2022/0099356 | A1 * | 3/2022 | Jackson | F25D 29/00 |

FOREIGN PATENT DOCUMENTS

| | | | |
|---|---|---|---|
| CN | 104102164 | A | 10/2014 |
| CN | 109654559 | A | 4/2019 |
| DE | 102015104631 | A1 | 9/2016 |
| EP | 1505350 | B1 | 12/2009 |

* cited by examiner

*Primary Examiner* — David J Teitelbaum
(74) *Attorney, Agent, or Firm* — Dority & Manning, P.A.

(57) ABSTRACT

A refrigerator appliance includes a cabinet defining a chilled chamber, a door being rotatably mounted to the cabinet to provide selective access to the chilled chamber, and a controller in operative communication with a moisture detection device through an external network. The controller is configured to obtain moisture readings from the moisture detection device, identify an elevated moisture event from the moisture readings, determine that a responsive action is needed based at least in part on the identification of the elevated moisture event, and implement the responsive action in response to identifying the elevated moisture event and determining that the responsive action is needed.

18 Claims, 3 Drawing Sheets

REFRIGERATOR APPLIANCE WITH CONDENSATION MITIGATION FEATURES

FIELD OF THE INVENTION

The present disclosure relates generally to refrigerator appliances, and more particularly to a refrigerator appliance with features for mitigating condensation in the event of ambient humidity spikes.

BACKGROUND OF THE INVENTION

Conventional refrigerator appliances include chilled chambers and other exposed surfaces that may be relatively cool compared to the surrounding environment. These cool surfaces may tend to form condensate when exposed to particularly warm or humid ambient conditions, resulting in undesirable refrigerator condensation problems, such as buildup in the freezer, on the doors, frames, and case mullions. Over time, condensation may also generate mold, mildew, or foul smells. Moreover, excessive moisture may deteriorate appliance performance, damage the appliance or the household where it is installed, or generally result in consumer dissatisfaction.

Notably, refrigerator appliances are frequently installed in environments where frequent humidity spikes occur, e.g., such as within a kitchen environment. For example, kitchens frequently include appliances that generate steam or tend to increase moisture within the environment, such as cooktops, ovens, dishwashers, etc. Conventional refrigerator appliances may include features for mitigating some condensation buildup, but these features are frequently operated according to a fixed time schedule or in response to the refrigerator performing specific actions. These features often do not provide real-time condensation mitigation for external high humidity events or conditions.

Accordingly, a refrigerator appliance with features for mitigating the buildup of condensation would be desirable. More specifically, a refrigerator appliance that uses real-time information related to an ambient environment to reduce or eliminate the formation of condensate would be particularly beneficial.

BRIEF DESCRIPTION OF THE INVENTION

Aspects and advantages of the invention will be set forth in part in the following description, may be apparent from the description, or may be learned through practice of the invention.

In one exemplary embodiment, a refrigerator appliance defining a vertical direction, a lateral direction, and a transverse direction is provided, including a cabinet defining a chilled chamber, a door being rotatably mounted to the cabinet to provide selective access to the chilled chamber, a controller in operative communication with a moisture detection device through an external network. The controller is configured to obtain moisture readings from the moisture detection device, identify an elevated moisture event from the moisture readings, determine that a responsive action is needed based at least in part on the identification of the elevated moisture event, and implement the responsive action in response to identifying the elevated moisture event and determining that the responsive action is needed.

In another exemplary embodiment, a method of operating a refrigerator appliance is provided, where the refrigerator appliance is in operative communication with a moisture detection device through an external network. The method includes obtaining moisture readings from the moisture detection device, identifying an elevated moisture event from the moisture readings, determining that a responsive action is needed based at least in part on the identification of the elevated moisture event, and implementing the responsive action in response to identifying the elevated moisture event and determining that the responsive action is needed.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
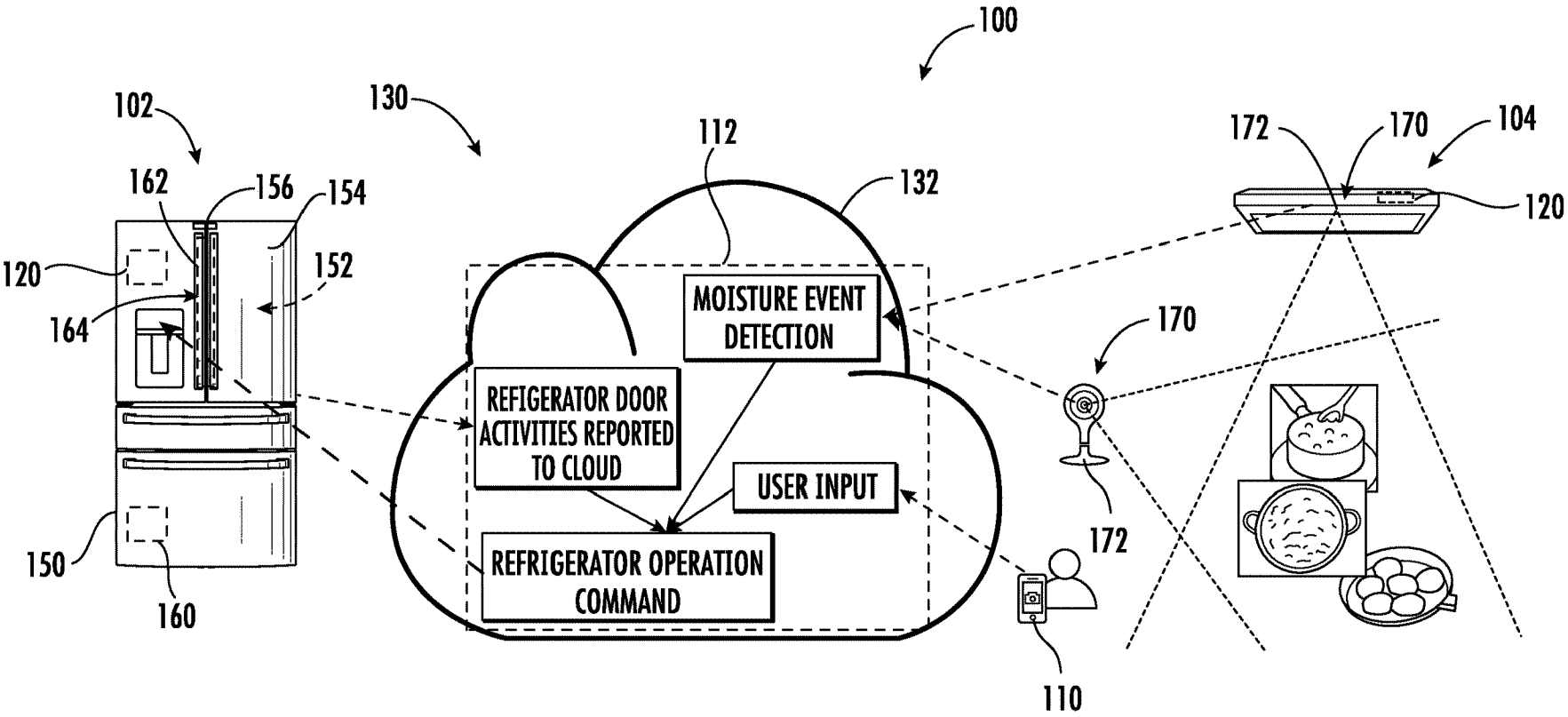
FIG. 1 provides a schematic view of a refrigerator appliance connected to a remote server and at least one moisture detection device through an external network according to an example embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Referring now to FIG. 1, a system of appliances 100 will be described according to exemplary embodiments of the present subject matter. In general, system of appliances 100 may include any suitable number, type, and configuration of appliances, remote servers, network devices, and/or other external devices. Some of these appliances 100 may be able to communicate with each other or are otherwise interconnected. This interconnection, interlinking, and interoperability of multiple appliances and/or devices may commonly be referred to as "smart home" or "connected home" appliance interconnectivity.

FIG. 1 illustrates system of appliances 100 according to exemplary embodiments of the present subject matter. As shown, system of appliances 100 generally includes a first appliance (e.g., illustrated herein as a refrigerator appliance 102) and a second appliance (e.g., illustrated herein as a fume hood 104). Details regarding the operation of refrigerator appliance 102 and fume hood 104 may be understood by one having ordinary skill in the art and detailed discussion is omitted herein for brevity. However, it should be appreciated that the specific appliance types and configurations are only exemplary and are provided to facilitate discussion regarding the use and operation of an exemplary system of appliances 100. The scope of the present subject matter is not limited to the number, type, and configurations of appliances set forth herein.

For example, the system of appliances 100 may include any suitable number and type of "appliances," such as "household appliances." These terms are used herein to describe appliances typically used or intended for common domestic tasks, e.g., such as the appliances as illustrated in the figures. According to still other embodiments, these "appliances" may include but are not limited to a refrigerator, a dishwasher, a microwave oven, a cooktop, an oven, a washing machine, a dryer, a water heater, a water filter or purifier, an air conditioner, a space heater, and any other household appliance which performs similar functions. Moreover, although only two appliances are illustrated, various embodiments of the present subject matter may also include another number of appliances, each of which may generate and store data.

In addition, it should be appreciated that system of appliances 100 may include one or more external devices, e.g., devices that are separate from or external to the one or more appliances, and which may be configured for facilitating communications with various appliances or other devices. For example, according to exemplary embodiments of the present subject matter, the system of appliances 100 may include or be communicatively coupled with a remote user interface device 110 that may be configured to enable user interaction with some or all appliances or other devices in the system of appliances 100.

In general, remote user interface device 110 may be any suitable device separate and apart from appliances (e.g., such as refrigerator appliance 102 and fume hood 104) that is configured to provide and/or receive communications, information, data, or commands from a user. In this regard, remote user interface device 110 may be an additional user interface to the user interface panels of the various appliances within the system of appliances 100. In this regard, for example, the user interface device 110 may be a personal phone, a smartphone, a tablet, a laptop or personal computer, a wearable device, a smart home system, or another mobile or remote device. For example, the separate device may be a smartphone operable to store and run applications, also known as "apps," and the remote user interface device 110 be provided as a smartphone app.

In addition, as will be described in more detail below, some or all of the system of appliances 100 may include or be communicatively coupled with a remote server 112 that may be in operative communication with remote user interface device 110 and/or some or all appliances within system of appliances 100. Thus, user interface device 110 and/or remote server 112 may refer to one or more devices that are not considered household appliances as used herein. In addition, devices such as a personal computer, router, network devices, and other similar devices whose primary functions are network communication and/or data processing are not considered household appliances as used herein.

As illustrated, each of refrigerator appliance 102, fume hood 104, remote user interface device 110, or any other devices or appliances in system of appliances 100 may include or be operably coupled to a controller, identified herein generally by reference numeral 120. As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 120 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 120 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 120 may be operable to execute programming instructions or micro-control code associated with an operating cycle of an appliance. In this regard, the instructions may be software or any set of instructions that when executed by the processing device, cause the processing device to perform operations, such as running one or more software applications, displaying a user interface, receiving user input, processing user input, etc. Moreover, it should be noted that controller 120 as disclosed herein is capable of and may be operable to perform any methods, method steps, or portions of methods as disclosed herein. For example, in some embodiments, methods disclosed herein may be embodied in programming instructions stored in the memory and executed by controller 120. The memory devices may also store data that can be retrieved, manipulated, created, or stored by the one or more processors or portions of controller 120. The data can include, for instance, data to facilitate performance of methods described herein. The data can be stored locally (e.g., on controller 120) in one or more databases and/or may be split up so that the data is stored in multiple locations. In addition, or alternatively, the one or more database(s) can be connected to controller 120 through any suitable communication module, communication lines, or network(s).

Referring still to FIG. 1, a schematic diagram of an external communication system 130 will be described according to an exemplary embodiment of the present subject matter. In general, external communication system 130 is configured for permitting interaction, data transfer, and other communications between and among refrigerator appliance 102, fume hood 104, remote user interface device 110, remote server 112, other appliances within system of appliances 100, and/or one or more external devices. For example, this communication may be used to provide and receive operating parameters, cycle settings, user instructions or notifications, performance characteristics, user preferences, or any other suitable information for improved performance of one or more appliances within system of appliances 100. In addition, it should be appreciated that external communication system 130 may be used to transfer data or other information to improve performance of one or more external devices or appliances and/or improve user interaction with such devices.

In addition, remote server 112 may be in communication with an appliance and/or remote user interface device 110 through a network 132. In this regard, for example, remote server 112 may be a cloud-based server 112, and is thus located at a distant location, such as in a separate state, country, etc. According to an exemplary embodiment, remote user interface device 110 may communicate with a remote server 112 over network 132, such as the Internet, to transmit/receive data or information, provide user inputs, receive user notifications or instructions, interact with or control the appliance, etc. In addition, remote user interface device 110 and remote server 112 may communicate with the appliance to communicate similar information.

In general, communication between an appliance, remote user interface device 110, remote server 112, and/or other user devices or appliances may be carried using any type of wired or wireless connection and using any suitable type of communication network, non-limiting examples of which are provided below. For example, remote user interface device 110 may be in direct or indirect communication with the appliance through any suitable wired or wireless communication connections or interfaces, such as network 132. For example, network 132 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 130 is described herein according to an exemplary embodiment of the present subject matter. However, it should be appreciated that the exemplary functions and configurations of external communication system 130 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

According to example embodiments of the present subject matter, refrigerator appliance 102 may generally include a cabinet 150 that defines a chilled chamber 152. A door 154 may be rotatably mounted to cabinet 150 to provide selective access to the chilled chamber 152. In addition, according to example embodiments, refrigerator appliance 102 may further include a door sensor 156 that is generally configured for detecting whether the door 154 is in the open or closed position. Although chilled chamber 152 is described herein as being the fresh food chamber of a french door refrigerator, it should be appreciated that aspects of the present subject matter may be equally applicable to other refrigerator appliances, other chilled chambers, and other surfaces of refrigerator appliances.

In addition, as will be appreciated by one having ordinary skill in the art, refrigerator appliance 102 may include a sealed system 160 which is generally configured for performing cooling operations within refrigerator appliance 102. In addition, sealed system 160 may include one or more features or methods of operation which may facilitate the performance of a defrost cycle. In general, the defrost cycle is intended to provide warm air to various surfaces and components of refrigerator appliance 102 that are prone to development of condensation, frost, etc. For example, the evaporator of sealed system 160 may generally form frost when operating in high humidity environments, and sealed system 160 may be configured to perform a defrost cycle where frost is removed from the evaporator, thereby improving sealed system efficiency.

In addition, refrigerator appliance 102 may include one or more heaters, such as a sweat heater 162 positioned at various locations for heating surfaces or regions where condensate is likely to collect and/or form frost. These sweat heaters 162 may be periodically energized to melt frost and/or evaporate collected condensate. For example, according to the illustrated embodiment, sweat heater 162 may be positioned on a mullion 164 where the doors 154 of refrigerator appliance 102 are seated in the closed position. In this regard, mullion 164 may be a relatively cool surface that has the tendency to form condensation, particularly when operating in a humid environment. As explained in more detail below, sealed system 160 and/or sweat heater 162 may be selectively energized to mitigate condensation events and illuminate the formation of frost.

Referring still to FIG. 1, system of appliances 100 may further include one or more moisture detection devices 170 that may be used to detect elevated moisture events, e.g., due to a periodic increase in the humidity of an environment where refrigerator appliance 102 is located, e.g., such as in a residential kitchen. For example, moisture detection devices 170 may be one or more humidity sensors (not shown) or one or more cameras 172. In general, camera 172 may include any suitable number, type, size, and configuration of imaging devices for obtaining images within or around refrigerator appliance 102. In general, cameras 172 may include a lens that is constructed from a clear hydrophobic material or which may otherwise be positioned behind a hydrophobic clear lens.

According to example embodiments, cameras 172 may be positioned at locations for detecting steam, mist, or other moisture within an environment surrounding refrigerator appliance 102. For example, camera 172 may be a standalone camera mounted within a kitchen where refrigerator appliance 102 is located. According to another example embodiment, camera 172 may be mounted on fume hood 104 that is positioned above a cooktop within the kitchen where refrigerator appliance 102 is located. In this regard, a common source of humidity spikes within a kitchen is food items that are being cooked on a cooktop. For example, steam that may emanate from cooking utensils on top of cooktop may cause humidity spikes that may result condensation on refrigerator appliance 102. Accordingly, camera 172 may be positioned within view of such humidity sources.

In addition, it should be appreciated that fume hood 104 may be a vented fume hood or a recirculating fume hood. In general, vented fume hoods include a fan for extracting air and moisture generated at the cooktop and discharging the air to an external environment, e.g., outside of the kitchen. By contrast, recirculating fume hoods may use a fan to draw in air and moisture and pass it through a filter before discharging the air back into the room where the fume hood is located. Notably, vented fume hoods may be more effective at reducing humidity within a room than recirculating fume hoods. As will be described in more detail below, methods of mitigating condensation formation may vary depending on whether the fume hood is vented or recirculating.

According to the illustrated embodiment, refrigerator appliance 102 may be in operative communication with moisture detection device 170 for monitoring humidity spikes within or around refrigerator appliance 102. In this regard, for example, controller 120 of refrigerator appliance 102 and moisture detection device 170 may both be in operative communication with an external communication system 130 (e.g., via network 132). In this manner, controller 120 of refrigerator appliance 102 may periodically obtain moisture readings from moisture detection device 170 and may implement condensation mitigation methods as described in more detail below.

Now that the construction of system of appliances 100 and external communication system 130 have been presented according to exemplary embodiments, an exemplary method 200 of performing condensation mitigation using a remote server coupled to a plurality of appliances will be described. Although the discussion below refers to the exemplary method 200 of performing condensation mitigation for a refrigerator appliance 102 using moisture detection device 170 on fume hood 104, one skilled in the art will appreciate that the exemplary method 200 is applicable to any other suitable number, type, and configuration of appliances and networks. In exemplary embodiments, the various method steps as disclosed herein may be performed by remote server 112, one or more controllers (e.g., such as controllers 120) or by a separate, dedicated controller that may be located locally on one or more of the appliances, remotely on a remote server, etc.

Figure 2:
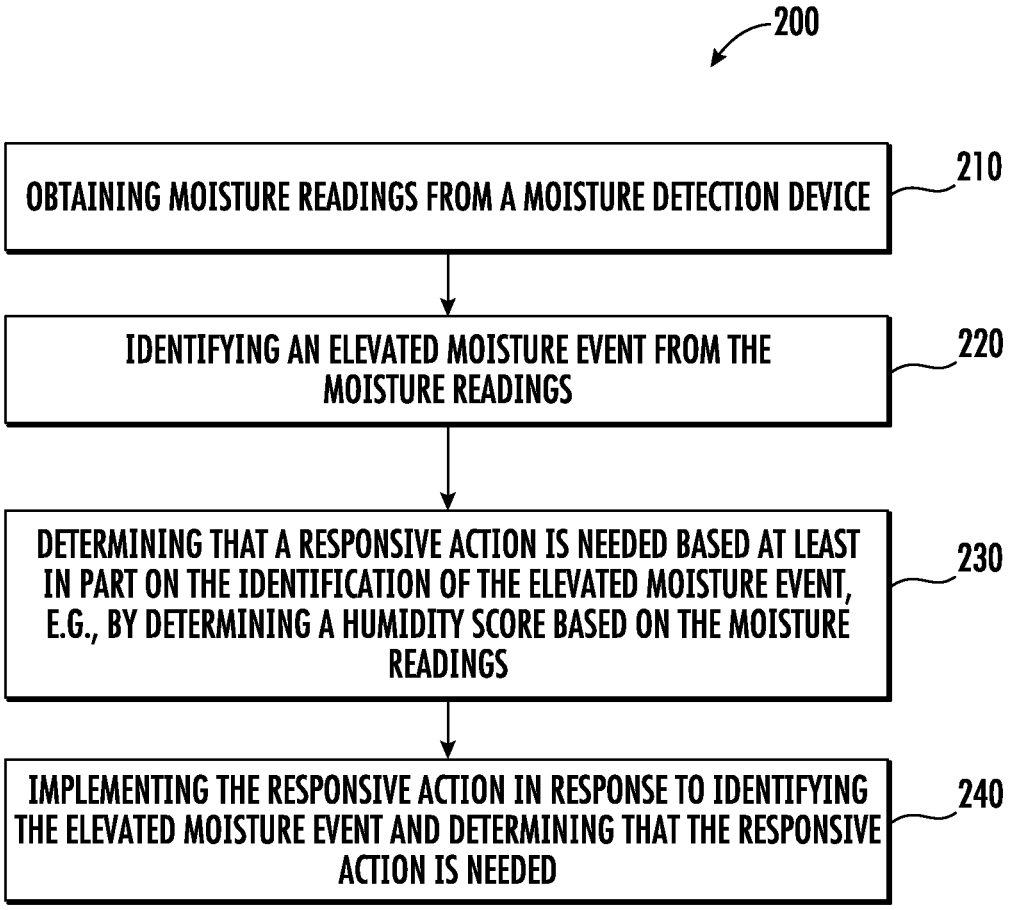
FIG. 2 provides a method for operating a refrigerator appliance to mitigate the formation of condensate according to an example embodiment of the present subject matter.

As shown in FIG. 2, method 200 includes, at step 210, obtaining moisture readings from the moisture detection device. In this regard, continuing the example from above, controller 120 of refrigerator appliance 102 may obtain moisture readings from camera 172 and may predict or monitor humidity levels and spikes and humidity in the area surrounding refrigerator appliance 102. Step 220 may generally include identifying an elevated moisture event from the moisture readings. In this regard, controller 120 of refrigerator appliance 102 may be programmed with predetermined acceptable levels of moisture within the room or may have other programming suitable to identify moisture events that may result in the formation of undesirable condensation (e.g., events referred to herein as "elevated moisture events").

Step 230 may generally include determining that responsive action is needed based at least in part on the identification of the elevated moisture event. In this regard, controller 120 may be programmed to determine that the increase in moisture or humidity may result in undesirable condensation and may perform a series of responsive actions that are intended to mitigate the effects of this humidity spike. Although exemplary factors that may be considered in determining whether a responsive action is needed will be described below, it should be appreciated that variations and modifications to the identification of elevated moisture events and the associated responsive actions may be made while remaining within the scope of the present subject matter.

For example, determining that the responsive action is needed may include determining a humidity score based on the obtained moisture readings. According to an example embodiment, the humidity score may account for the level of the humidity spike, the current operating state of refrigerator appliance 102, other conditions of the ambient environment, surface temperatures of refrigerator appliance 102, and other useful operating information such as the frequency and duration of door opening events. According to example embodiments, the responsive action may be selected as a function of the humidity score, e.g., with a higher humidity score resulting in more aggressive actions to reduce the formation of condensate, frost formation, etc.

In this regard, according to an example embodiment, higher humidity levels and more elevated humidity spikes may result in a higher humidity score. In addition, refrigerator appliance 102 may use door sensor 156 to determine how frequently door 154 has been opened during an elevated moisture event, the duration of such door opening events, etc. Based on this information, controller 120 may be programmed to calculate a humidity score that is used to determine which responsive actions need to be taken.

Step 240 may generally include implementing the responsive action in response to identifying the elevated moisture event and determining that the responsive action is needed. For example, continuing the example from above, if the humidity score indicates that the formation of condensate is likely, refrigerator appliance 102 may perform various actions to reduce frost formation, melt formed ice, or reduce and evaporate condensate. For example, implementing the responsive action may include performing one or more defrost cycles using parameters selected based at least in part on the humidity score and the quantity or duration of the door opening events. In this regard, if the humidity score is high and the door 154 has been open for a long time during the elevated moisture event, a more aggressive or elongated defrost cycle may be performed. By contrast, if the door 154 was not opened during the elevated moisture event, a brief defrost cycle or no defrost cycle at all may be performed.

According to example embodiments, implementing the responsive action may further include turning on sweat heater 162 to evaporate collecting condensation, e.g., on mullion 164 of refrigerator appliance 102. In addition, other heaters located throughout refrigerator appliance 102 may be energized to heat selected regions or surfaces of refrigerator appliance 102, thereby evaporating condensate, melting frost, etc. In addition, according to example embodiments, the responsive action may vary depending on whether fume hood 104 is a vented fume hood or a recirculating fume hood. In this regard, the responsive action taken by refrigerator appliance 102 may be more aggressive if the fume hood is a recirculating fume hood instead of a vented fume hood.

Figure 3:
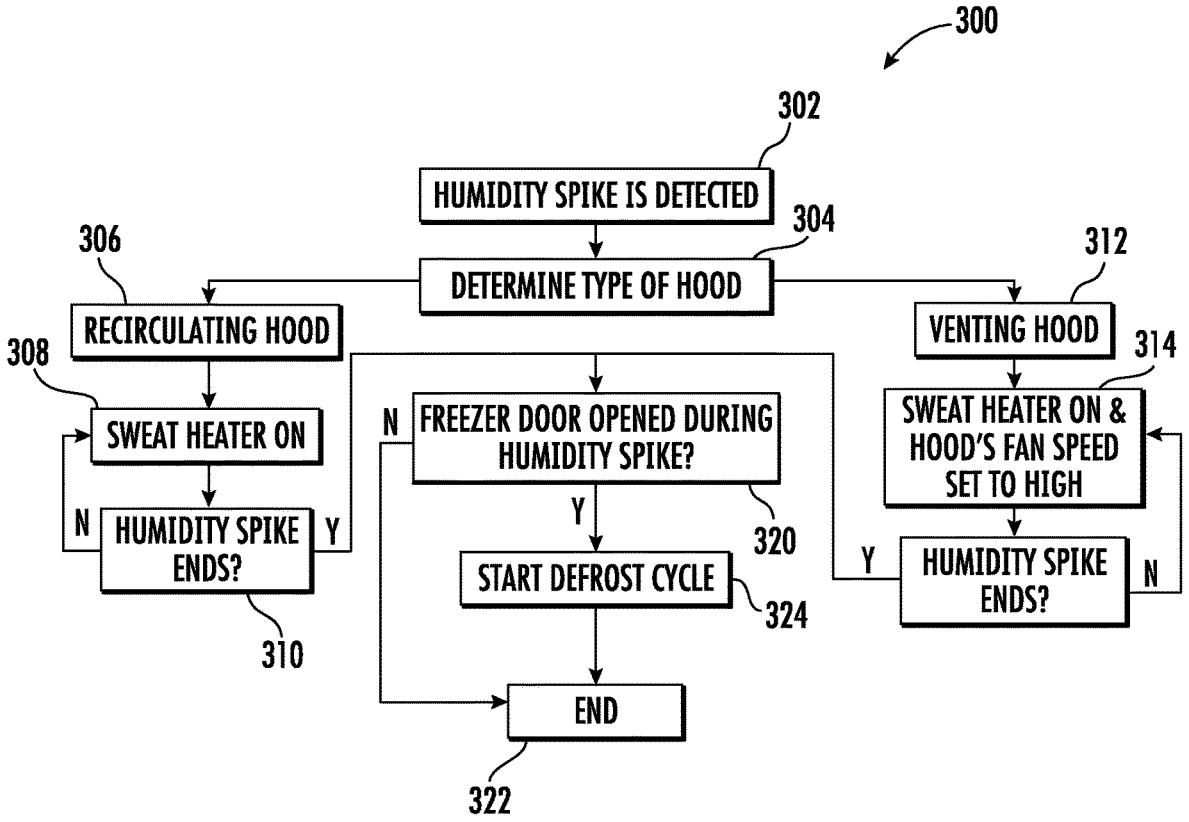
FIG. 3 provides a method mitigating condensation of a refrigerator appliance according to an example embodiment of the present subject matter.

Referring now briefly to FIG. 3, a method 300 for performing condensate reduction of a refrigerator appliance will be described according to an example embodiment of the present subject matter. It should be appreciated that some or all of the steps of method 300 may be the same or similar to steps of method 200, and like reference numerals may be used to refer to the same or similar steps herein. Specifically, step 302 may include detecting a humidity spike in an area surrounding refrigerator appliance 102. For example, continuing the example from above, controller 120 of refrigerator appliance 102 may use moisture detection device 170 of fume hood 104 to determine that a large amount of steam is being generated at a cooktop. This large amount of steam may qualify as an elevated moisture event.

Step 304 may generally include determining the type of fume hood 104 present within the kitchen. Step 306 may include determining that the fume hood is a recirculating hood and step 308 may include turning sweat heater 162 on. Step 308 may generally include determining whether the humidity spike is reduced after turning on the sweat heater. If the humidity spike is not reduced, the sweat heater may remain on until the humidity spike is reduced. By contrast, step 312 may include determining that the fume hood is a vented hood and step 314 may include turning on the sweat heater and setting the fan speed to high. If the humidity spike is not reduced, the sweat heater and the fan may remain on until the humidity spike is reduced.

Step 320 may generally include determining whether the door of the chilled chamber was opened during the humidity spike. If the door was not opened, method 300 may proceed to step 322 where the condensate mitigation process is ended, e.g., under the assumption that a defrost cycle is not needed because the door was not opened. By contrast, if the door was opened, step 324 may include starting a defrost cycle to defrost the chilled chamber, the evaporator, or other surfaces or regions of refrigerator appliance 102 before ending the process at step 322. As described briefly above, the parameters of this defrost cycle may vary depending on the moisture readings (e.g., the severity of the humidity spike), along with the number and duration of door opening occurrences.

FIGS. 2 and 3 depict exemplary control methods having steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of these methods are explained using system of appliances 100 and remote server 112 as an example, it should be appreciated that these methods may be applied to the condensate mitigation for any other refrigerator appliance.

As explained herein, aspects of the present subject matter are generally directed to a system and method for minimizing condensation in refrigerators based on moisture event detection wherein cameras may be used to capture real-time images of surrounding space and detect the events that may cause high moisture levels. Further, based on the detection of such an event, the system may automatically activate a sweat heater and/or initiate a defrost cycle to prevent condensation build-up and maintain desirable refrigerator performance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A refrigerator appliance defining a vertical direction, a lateral direction, and a transverse direction, comprising:
- a cabinet defining a chilled chamber;
- a door being rotatably mounted to the cabinet to provide selective access to the chilled chamber; and
- a controller in operative communication with a moisture detection device through an external network, wherein the moisture detection device is mounted to a fume hood in operative communication with the external network, the controller being configured to:
  - obtain moisture readings from the moisture detection device;
  - identify an elevated moisture event from the moisture readings;
  - determine that a responsive action is needed based at least in part on the identification of the elevated moisture event; and
  - implement the responsive action in response to identifying the elevated moisture event and determining that the responsive action is needed.

2. The refrigerator appliance of claim 1, wherein the moisture detection device is a camera.

3. The refrigerator appliance of claim 2, wherein the camera is a standalone camera.

4. The refrigerator appliance of claim 1, wherein the moisture detection device is a humidity sensor.

5. The refrigerator appliance of claim 1, wherein the fume hood is a vented fume hood or a recirculating fume hood, and wherein the responsive action varies based on the fume hood being the vented fume hood or the recirculating fume hood.

6. The refrigerator appliance of claim 1, wherein determining that the responsive action is needed based at least in part on the identification of the elevated moisture event further comprises:

determining a humidity score based on the moisture readings, wherein the responsive action is a function of the humidity score.

7. The refrigerator appliance of claim 6, further comprising a door sensor, wherein the controller is further configured to:

detect that the door has been opened using the door sensor, wherein the humidity score is determined based at least in part on a quantity or duration of door opening events.

8. The refrigerator appliance of claim 7, wherein the controller is further configured to:

perform one or more defrost cycles using parameters selected based at least in part on the humidity score and the quantity or duration of the door opening events.

9. The refrigerator appliance of claim 1, further comprising:

a sweat heater, wherein implementing the responsive action comprises turning on the sweat heater to evaporate collected condensation.

10. The refrigerator appliance of claim 9, wherein the sweat heater is mounted on a mullion of the refrigerator appliance.

11. The refrigerator appliance of claim 1, wherein implementing the responsive action comprises implementing a defrost cycle in response to detecting that a door has been opened during the elevated moisture event.

12. A method of operating a refrigerator appliance, the refrigerator appliance being in operative communication with a moisture detection device through an external network, wherein the moisture detection device is mounted to a fume hood in operative communication with the external network, the method comprising:

obtaining moisture readings from the moisture detection device;

identifying an elevated moisture event from the moisture readings;

determining that a responsive action is needed based at least in part on the identification of the elevated moisture event; and implementing the responsive action in response to identifying the elevated moisture event and determining that the responsive action is needed.

13. The method of claim 12, wherein the moisture detection device is a camera mounted to an auxiliary appliance in operative communication with the external network.

14. The method of claim 13, wherein the responsive action varies based on the fume hood being the vented fume hood or the recirculating fume hood.

15. The method of claim 12, wherein determining that the responsive action is needed based at least in part on the identification of the elevated moisture event further comprises:

determining a humidity score based on the moisture readings, wherein the responsive action is a function of the humidity score.

16. The method of claim 15, wherein the refrigerator appliance further comprises a door and a door sensor, the method further comprising:

detecting that the door has been opened using the door sensor, wherein the humidity score is determined based at least in part on a quantity or duration of door opening events.

17. The method of claim 16, further comprising:

performing one or more defrost cycles using parameters selected based at least in part on the humidity score and the quantity or duration of the door opening events.

18. The method of claim 12, wherein the refrigerator appliance comprises a sweat heater mounted on a mullion of the refrigerator appliance, and wherein implementing the responsive action comprises turning on the sweat heater to evaporate collected condensation.

* * * * *